US009933119B2

(12) United States Patent
Bernays et al.

(10) Patent No.: US 9,933,119 B2
(45) Date of Patent: Apr. 3, 2018

(54) FLOATING LNG PLANT

(75) Inventors: Adam Bernays, Menton (FR); Hein Wille, Eze (FR); Jeremy Duncan Stuart Joynson, Kuala Lumpur (MY)

(73) Assignee: Single Buoy Moorings, Inc., Marty (CH)

( * ) Notice: Subject to any disclaimer, the term of this patent is extended or adjusted under 35 U.S.C. 154(b) by 912 days.

(21) Appl. No.: 13/989,976

(22) PCT Filed: Sep. 16, 2011

(86) PCT No.: PCT/EP2011/066157

§ 371 (c)(1),
(2), (4) Date: Jul. 16, 2013

(87) PCT Pub. No.: WO2012/072292

PCT Pub. Date: Jun. 7, 2012

(65) Prior Publication Data

US 2013/0283825 A1 Oct. 31, 2013

(30) Foreign Application Priority Data

Nov. 30, 2010 (EP) ..... 10193110

(51) Int. Cl.
*F17C 13/08* (2006.01)
*B63B 35/44* (2006.01)
(Continued)

(52) U.S. Cl.
CPC ..... *F17C 13/082* (2013.01); *B63B 35/44* (2013.01); *F25J 1/0022* (2013.01); *F25J 1/0259* (2013.01);
(Continued)

(58) Field of Classification Search
CPC ... B63B 2035/448; B63B 25/28; B63B 25/18; B63B 2001/186; B63B 3/08;
(Continued)

(56) References Cited

U.S. PATENT DOCUMENTS 2,686,323 A * 8/1954 Felio ..... B63C 9/01 114/348
5,778,813 A * 7/1998 Kennedy ..... B32B 15/06 114/69
(Continued)

FOREIGN PATENT DOCUMENTS

WO WO-02/095284 A1 11/2002
WO WO-2010 0059059 A1 5/2010

OTHER PUBLICATIONS

Brumer, A., "International Search Report", for PCT/EP2011/066157, dated Jan. 26, 2012, 6 pages.

*Primary Examiner* — Elizabeth Martin
*Assistant Examiner* — Zachary R Anderegg
(74) *Attorney, Agent, or Firm* — Winstead PC

(57) ABSTRACT

The present invention relates to a floating LNG plant (1, 1', 100) comprising a converted LNG carrier with a hull and a plurality of LNG storage tanks (4, 104) wherein in that the floating LNG plant (1, 1', 100) comprises: —at least one sponson (2, 2', 3, 3', 102, 103) on the side of the hull, for creating additional hull volume, —process equipment (110) for LNG processing on the floating LNG plant (1, 1', 100), and—a reservoir for storing fluids separated during the LNG processing, wherein said reservoir is formed by the ballast tank or in the space reserved for the ballast tank of the original LNG carrier.

13 Claims, 5 Drawing Sheets

(51) Int. Cl.
*F25J 1/00* (2006.01)
*F25J 1/02* (2006.01)

(52) U.S. Cl.
CPC ..... *F25J 1/0278* (2013.01); *B63B 2035/448* (2013.01); *F25J 2290/60* (2013.01); *Y10T 29/49716* (2015.01)

(58) Field of Classification Search
CPC .. B63B 9/065; B63B 2025/087; F25J 1/0278; F17C 3/025; F17C 2270/0113; F17C 2270/0105
See application file for complete search history.

(56) References Cited

U.S. PATENT DOCUMENTS

| | | | | |
|---|---|---|---|---|
| 5,894,807 | A * | 4/1999 | Aiken | B63B 1/14 114/102.18 |
| 6,044,784 | A | 4/2000 | Gee et al. | |
| 2006/0156744 | A1 | 7/2006 | Cusiter et al. | |
| 2006/0180231 | A1 | 8/2006 | Harland et al. | |
| 2007/0289517 | A1 * | 12/2007 | Poldervaart | B63B 21/04 114/230.15 |
| 2008/0295526 | A1 | 12/2008 | Boatman et al. | |
| 2009/0078185 | A1 * | 3/2009 | Poldervaart | B63B 27/24 114/256 |
| 2010/0108145 | A1 | 5/2010 | Danaczko et al. | |

* cited by examiner

FLOATING LNG PLANT

FIELD OF THE INVENTION

The invention relates to a floating LNG plant comprising at least a hull and a plurality of liquefied LNG storage tanks.

The invention also relates to a method for converting a LNG carrier into a floating LNG plant, wherein the LNG carrier comprises at least a hull, a plurality of LNG storage tanks and at least one ballast tank for stabilizing the LNG vessel.

BACKGROUND OF THE INVENTION

In the present text, reference is made to a floating LNG plant. Such a floating LNG plant is, for instance, a floating production, storage and offloading unit (FPSO), a floating LNG storage and a regasification unit (FSRU) or a floating power plant comprising LNG tanks (FPGU).

A FPSO, or Floating Production, Storage and Offloading unit is a floating vessel used by the offshore industry for the processing and storage of oil and gas. A FPSO vessel is designed to receive oil or gas produced from a nearby plant or a subsea template, process it, and store it until the oil or the gas can be offloaded onto a tanker or transported through a pipeline.

An FPSO can be obtained by conversion of an oil or gas tanker or can be specifically built for the application. The advantage of a converted FPSO is that using an existing tanker reduces project risks because the vessel is already available and not on the critical path. Project schedules can be reduced to the delivery time of the topsides only and the overall scale of the projects become similar to the typical larger oil conversion FPSO projects.

Solutions for converting a vessel in a LNG FPSO that exist usually propose removal of one or more gas tanks to provide deck space for installing process equipment, needed for the processing of the gas on the vessel. Therefore, converted LNG FPSO's according to the prior art normally have limited remaining storage capacity for storing liquified gas on board of the LNG FPSO.

The international patent application WO2010059059 discloses a device for floating production of LNG and a method for converting an LNG-carrier to a floating device for LNG production. According to WO2010059059 the existing LNG-carrier is provided with an additional projecting hull structure fixed to the ship hull. Thereafter the equipment for the LNG production is arranged in this projecting hull structure. That means that according to WO2010059059 the additional internal space created by adding the projecting hull structure is used to contain at least part of the gas liquefaction process equipment.

The solution according to WO2010059059 has the disadvantage that the gas process equipment is contained in an enclosed space, which can potentially lead to very dangerous situations because of the risk of an explosion in an enclosed space due to leakage of gas from the gas process equipment.

Another disadvantage is linked to the fact that according to the solution of WO2010059059 the gas liquefaction process equipment is installed in the space created at the side of the hull, which leads to a dangerous configuration in view of possible side collisions, with for example a shuttle tanker. Such side collisions would directly damage the gas process equipment in the projecting hull structures.

SUMMARY OF THE INVENTION

The object of the present invention is to provide a floating LNG plant with an overall design which provides more safety then the floating LNG plants known from the prior art.

According to a first aspect of the invention, the invention relates to a floating LNG plant comprising a converted LNG carrier with a hull and a plurality of LNG storage tanks wherein the floating LNG plant comprises:

- at least one sponson (2, 2', 3, 3', 102, 103) on the side of the hull, for creating additional hull volume,
- process equipment (110) for LNG processing on the floating LNG plant (1, 1', 100), and
- a reservoir for storing fluids separated during the LNG processing, wherein said reservoir is formed by the ballast tank or in the space reserved for the ballast tank of the original LNG carrier.

In the present text the phrase 'floating LNG plant' is used. This phrase refers to any LNG carrier that has been converted in order to be used for LNG processing and storage.

Once the original LNG carrier has been converted, the result is a floating LNG plant which for instance can be used as a FPSO, FSRU or a FPGU.

In the present text, the phrase "LNG carrier" is used. This means a vessel that has originally been constructed for transporting LNG. When in the text reference is made to an "original LNG carrier", reference is made to the LNG carrier prior to the converting of the LNG carrier to a floating LNG plant.

In the present text the word "sponson" is used. The word sponson refers to any projecting hull structure in order to provide additional hull volume. The sponson normally extends along the length of a vessel. Optionally the top side of the sponson can be made flat. The top side could be adapted to be flush the vessel's main deck. However, it should be noted that the top side of a sponson does not need to be flat and does not need to be flush with the vessel's main deck. It is very well possible to connect a sponson to the hull below the main deck. This is in fact preferable both for constructability and for reducing stress concentrations at the connections.

A first technical effect of the invention is the fact that the addition of a sponson allows the vessel to carry more cargo overall. Any vessel will require, under statutory codes, a certain amount of reserve ballast spaces by which to control weight and draft of the vessel in both normal and damage scenarios. In the in the case of a normal LNG carrier this ballast space is provided by the side (wing) tanks which make up the double hull space.

According to the invention the volume added by the sponson enable the conversion of those reserve ballast spaces, that previously would only have been permitted to carry ballast water or to be void, into tanks for storage of fluids such as oil, condensates or other waste products that result from the LNG processing on board of the floating LNG plant. According to the invention the ballast tanks of the original LNG carrier could be used for storing of those fluids. Alternatively, the space that was available for the original ballast tanks can be used to partially house newly constructed tanks for the fluids wherein those tanks extend, for their remaining part into the space crated by the adding of a sponson.

A second advantage of the configuration of the floating LNG plant, according to the invention, is the fact that the adding of a sponson will increase the separation distance of the LNG storage area of the vessel from the side of the vessel, which represents the point of impact in a possible side collision by another vessel like a LNG carrier or supply vessel. Therefore, this increase of the separation distance will add additional collision safety.

As the floating LNG plants moored to the seabed, sponsons will make the moored vessel more stable; the uptime of the high process towers is depending on vessels (roll) motions and a more stable vessel will increase the process uptime.

Yet a further advantage of the presence a sponson is that it will increase the overall strength of the hull. Hull deformations, like hogging and sagging, are therefore limited and more deck load can be added to a vessel that is provided with sponsons.

According to a preferred embodiment of the invention, the sponson of the floating LNG plant provides double hull protection.

According to a preferred embodiment of the invention, the vessel comprises a new ballast tank for the floating LNG plant in the additional hull volume created by the adding of the sponson to the side of the hull.

According to a preferred embodiment of the invention, the process equipment for LNG processing on the floating LNG plant is installed on the additional deck space created by the adding of the at least one sponson on the side of the hull. To be able to have all the LNG processing equipment on the open deck area which is created by the adding of the sponson, the process modules need to be "stretched" as the width of the process modules must be adjusted to the available width of the sponson.

The effect is that the sizes of the process modules are in general longer but also smaller compared to normal modules for LNG processing.

According to a preferred embodiment of the invention, the sponson is used for supporting LNG transfer devices.

According to a preferred embodiment of the invention, the LNG FPSO is provided with two sponsons (2, 2', 3, 3', 102, 103) each on one side of the vessel, the first sponson (2, 2', 102) is used for supporting LNG transfer devices (111) and the second sponson (3, 3', 103) is used for supporting LNG process equipment (110).

According to a preferred embodiment of the invention, the sponson is used for storage of a floating offloading hose. An effect of this measure is the fact that the link of the sponson can be used for the storage of the floating LNG offloading hose, for instance in a gutter on the sponson, for a tandem of loading configuration of two vessels. In that case, no hose real would be needed at the haft of the floating LNG plant.

According to a preferred embodiment of the invention, a power generation unit is placed within the sponson.

According to a preferred embodiment of the invention, the floating LNG plant further comprises a mooring system and a fluid transfer system, the fluid transfer system including a swivel and piping connecting the swivel to process equipment for liquefaction on the floating LNG plant.

It is possible that the floating LNG plant comprises an external turret in order to allow the LNG FPSO to be weathervaning moored to the seabed via said external turret.

Alternatively, the floating LNG plant comprises an offloading buoy in order to allow the floating LNG plant to be weathervaning moored to the seabed via said offloading buoy.

According to a preferred embodiment of the invention the outer shell of the at least one sponson is provided with a collision protection.

It is possible that the outer shell of the at least one sponson is protected against collision damage using SPS.

As the vessel is moored to the seabed, sponsons will make the moored vessel more stable; the uptime of the high process towers is depending on vessels motions and a more stable vessel will increase the process uptime. This is why just side deck extensions instead of sponson are not a preferred solution.

According to a second aspect of the invention, the invention relates to method for converting a LNG carrier into a floating LNG plant, wherein the LNG carrier comprises at least a hull, a plurality of LNG storage tanks and at least one ballast tank for stabilizing the LNG carrier and wherein the method comprises the steps of:

- adding at least one sponson on the side of the hull, for creating additional hull volume,
- installing process equipment for LNG processing on the vessel,
- using the ballast tank or the space reserved for the ballast tank of the original LNG carrier to create a reservoir for storing hydrocarbons separated during the LNG processing, and
- using the additional hull volume created by the adding of the sponson to create a new ballast tank for the floating LNG plant.

According to a preferred embodiment of the invention, the method comprises the step of installing process equipment for LNG processing on the vessel on the additional deck space created by the adding of the at least one sponson on the side of the hull.

According to a preferred embodiment of the invention the method comprises the step of providing the outer shell of the at least one sponson with a collision protection.

According to a further aspect of the invention, the invention relates to a natural gas distribution system for supplying natural gas to users where said natural gas has been transported as LNG by a LNG carrier that has sailed from a liquefying station to a coastal gas receiving facility located at a sea coast in the vicinity, comprising:

- at least a converted floating LNG plant having production storage and offloading capability and provided with at least one sponson on the side of the hull, for creating additional hull volume, and
- a LNG FSRU (floating storage regas unit) (85) that lies at said coastal gas receiving facility, and that heats LNG to produce gaseous natural gas and that is connected to said facility to carry said gaseous natural gas through said facility.

According to a preferred embodiment the natural gas distribution system comprises a floating LNG plant, wherein the floating LNG plant is a floating LNG plant according to the invention.

BRIEF DESCRIPTION OF THE DRAWINGS

The invention and the advantages thereof will be better understood, after the description below, which makes reference to the drawings, wherein:

FIG. 1 shows a side and a top view of a possible embodiment of a floating LNG plant 1 according to the present invention. In FIGS. 1-6, reference is made to a floating LNG plant which has the form of an LNG FPSO. It should be understood that the advantages of the current invention can also be used in converting an existing LNG carrier into another floating LNG plant, such as an FSRU or an FPGU. The FPGU and FSRU are not shown in the figures.

Typically, an FPGU would have power generation unit, equipment for gas treatment and power export facilities such as cables. If required, an FPGU could also be equipped with liquid export facilities.

Typically, an FSRU would have equipment in order to transform LNG into gas. The floating LNG plant 1, according to the present invention, is moored via an external turret 10. The floating LNG plant 1 can weathervane around the turret 10. The floating LNG plant 1 is obtained by converting an existing LNG carrier vessel. The original LNG carrier vessel is for instance a Moss type tanker which has a steam boiler propulsion system.

If the facility is to be used on a relatively rich gas field with a high condensate production rate the additional revenue it will generate will easily fund a separate condensate FSO (not shown), located nearby. This approach means that a relatively cheap standard LNG FPSO 1 can be built for both lean and rich gas fields, and can increase the potential opportunities for relocation.

Figure 1:
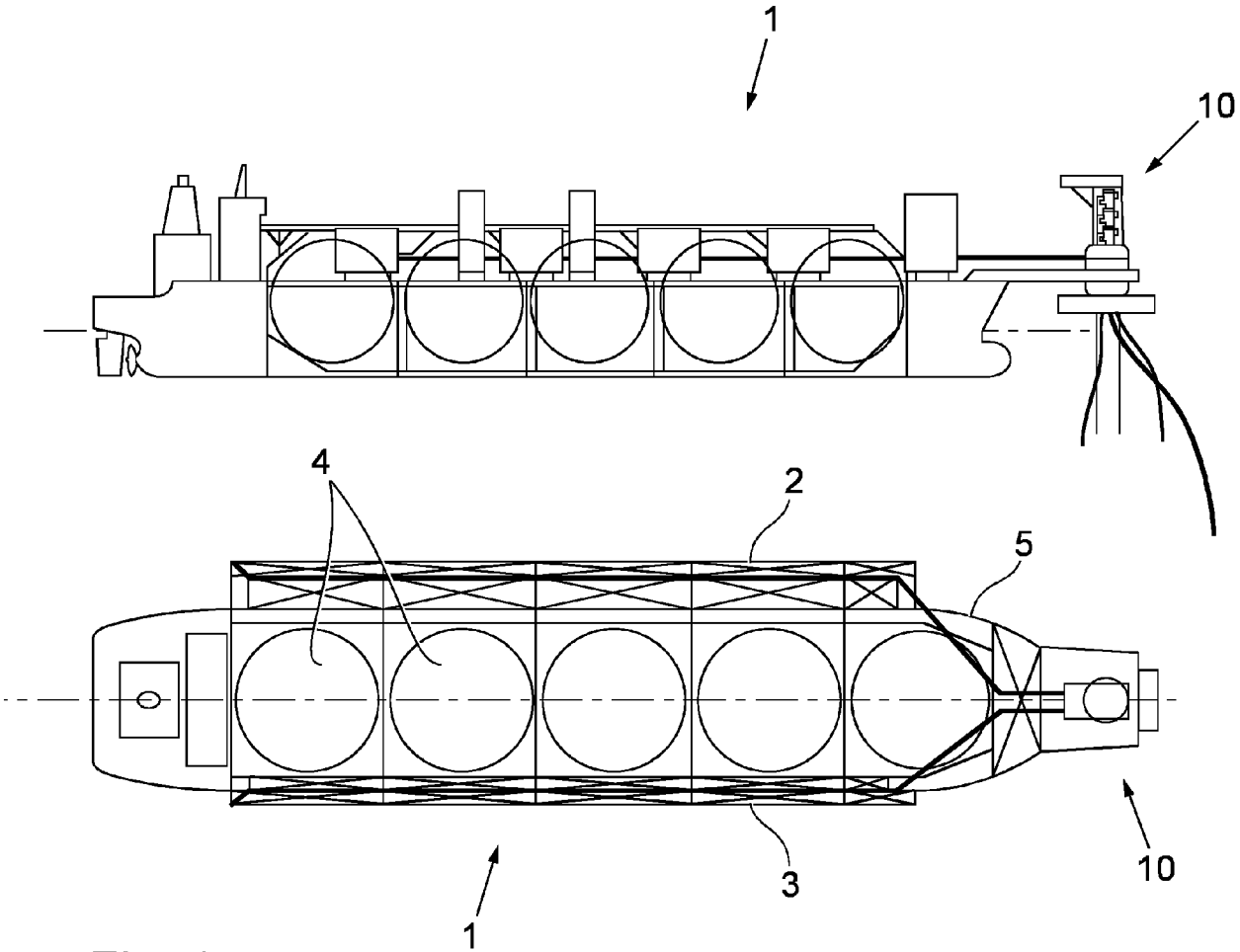
FIG. 1 shows a side and a top view of a possible embodiment of a floating LNG plant according to the present invention, which is moored via an external turret.

As can be seen in the top view in FIG. 1, the floating LNG plant 1 has a relatively wide sponson 2 on the larboard side of the hull. On the starboard side the floating LNG plant 1 is provided with a sponson 3 which is smaller then the sponson 2 on the larboard side.

It has to be understood that the floating LNG plant 1 could also be equipped with similar sized sponsons on both sides of the vessel 1.

According to FIG. 1 the original moss type tanker and therefore the floating LNG plant 1 is provided with 5 or 4 LNG tanks. The use of the moss type tanker has the advantage that the spherical moss type of LNG storage tanks provides ideal slosh tolerant storage for LNG and LPG.

According to FIG. 1 the floating LNG plant 1 is provided with an external turret 10. In an alternative embodiment (not shown) the floating LNG plant 1 could be provided with an alternative mooring system with an internal turret mooring system (not shown), such as a disconnectable (submerged) offloading buoy. The construction of such a disconnectable offloading buoy is well known in the art and will not be described in detail. Another alternative mooring system (not shown) is a well known spread moored mooring arrangement that is non-weathervaning.

In the embodiments shown in FIG. 1 the external turret 10 allows the floating LNG plant 1 to be designed with the ability to disconnect, for example for operation in cyclone areas, or for quick hook-up and/or ease of relocation on several very small gas fields in a campaign approach to gas monetization. Quick mooring line disconnection means also that major refits or maintenance can much more readily be carried out in a yard and returned quickly to service. The Riser Turret Mooring (RTM) would be ideal for this type of facility.

Figure 2:
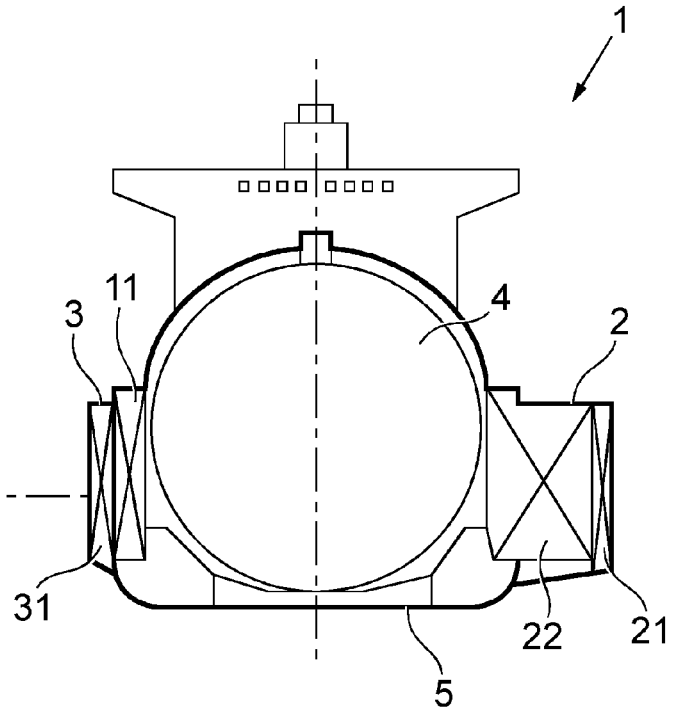
FIG. 2 shows a cross section of the floating LNG plant according to FIG. 1.
Figure 3:
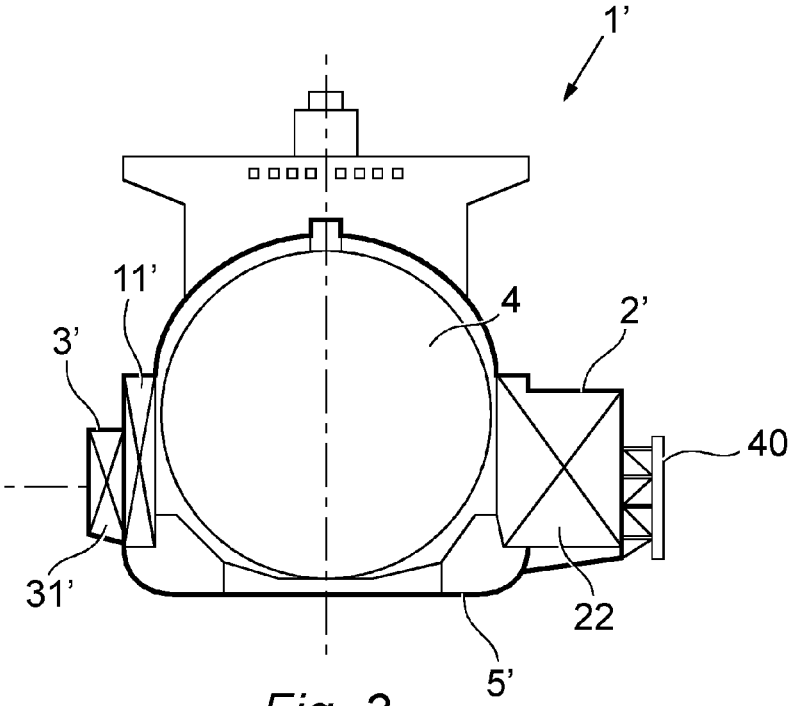
FIG. 3 shows a cross section of a alternative embodiment of the floating LNG plant according to the invention.

Possible embodiments of the sponsons 2 and 3 are shown in FIGS. 2 and 3.

As will be explained with reference to FIGS. 2 and 3, the additional sponsons 2 and 3 are fixed to the hull 5, 5' and offer all the required additional volume and space both above and below deck for the additional equipment which is required to provide the LNG carrier vessel to be operated as a LNG FPSO. The steam drive of the ship provides an installed boiler with which all of the electrical demand can be supplied through new steam turbine generators (not shown) which could be located in the sponsons 2, 3.

The sponsons 2, 3 are designed to expand the width of the ship up to the maximum width that is still able to enter the majority of dry docks in the world. This means that the overall width is limited to about 59 m.

According to FIG. 2 the sponson 3 at the starboard side of the floating LNG plant 1, 1' is provided with a space which serves as a ballast tank. That means that the original ballast tank that is present in the internal hull space indicated with reference number 11 can get a new function, the function of ballast is taken over by the space 31 in the sponson 3. The former ballast tank available in the space 11 can now be used for storing condensate or other residual fluids which are produced in the LNG liquefaction process.

At the starboard side the floating LNG plant 1 has an improved collision protection by the presence of the sponson 3. The collision protection could be improved by using a double walled sponson 3. The collision protection could be even further improved against collision damage by using a polymer based plate structures such as SPS (Sandwich Plate System).

According to FIG. 2 the sponson 2 at the starboard side of the floating LNG plant 1 is provided with a space 21 which serves as a ballast tank. The interior of the remaining part of the sponson 2 in combination with the space that was originally reserved for a ballast tank (see starboard side) is used to created a new storage space 22 used for storing condensate or other residual fluids which are produced in the LNG liquefaction process. That means that the original ballast tank on the larboard side has been removed or enlarged in order to create the relatively large storage space 22 on the larboard side of the floating LNG plant 1.

In FIG. 3 an alternative arrangement for the sponsons 2' and 3' is shown. According to FIG. 3 the sponson 3' at the starboard side has a similar configuration as the sponson 3 according to FIG. 2 in order to allow the original space for the ballast tank 11 to be used for storing condensate or other residual fluids which are produced in the LNG liquefaction process. The space 31' is available to serve as ballast tank.

The sponson 2' at the larboard side of the floating LNG plant 1' according to FIG. 3 is provided with a space 22' which comprises the interior of the sponson 22' in combination with the space that was originally reserved for a ballast tank (see starboard side) to created a relatively large storage space 22' for storing condensate or other residual fluids which are produced in the LNG liquefaction process.

In order to improve the collision protection of the floating LNG plant 1' according to FIG. 3 the exterior of the sponson 2' is provided with an adapted collision protection 40. This collision protection 40 is adapted to absorb energy during an impact in order to avoid or limit damage to the part of the floating LNG plant 1 that comprise either equipment for the LNG liquefaction process or that comprise storage space either for gas or for the condensate or other residual fluids which are produced in the LNG liquefaction process.

As shown in FIGS. 1, 2 and 3 the sponsons 2' and 3' provide a large amount of additional deck space for several uses. This will make the concept feasible without removing any of the existing LNG tanks 4'.

The length of the sponson 2, 2', 3, 3' can be used for lengthwise storage of a floating LNG offloading hose. This could for instance be in a gutter on the spoon deck or within the sponsons 2, 2', 3, 3'. The LNG offloading hose would be used for a known tandem offloading configuration of two vessels. In case the floating LNG offloading hose would be stored in this way, no hose real is needed on the haft of the floating LNG plant 1. It should be noted that a hose real normally takes a lot of deck space.

A standard LNG moss type carrier has either four or five tanks 4. The tanker according to FIGS. 1-4 has 5 tanks. Retaining all tanks 4 means that with one taken out of service temporarily for inspection or maintenance the remaining tanks 4 will be able to be used to provide an effective ongoing operation with one tank for LPG and two or three tanks used for LNG.

It is envisaged that a floating LNG plant 1 with sponsons 2, 2', 3, 3' of say less than 4-5 m breadth, oil/condensate would be stored in tanks that had previously been used for ballast. Broader sponsons 2, 2', 3, 3' would allow the combined storage of both hydrocarbons and tanks for dynamic ballast systems within the new structure.

The top side of the sponsons 2, 2, 3, 3' does not need to be flat and does not need to be flush with the tanker's main deck. The sponsons 2, 2', 3, 3' may be connected (horizontally, upper) below the main deck which is preferable both for constructability and for reducing stress concentrations at the connection. A substantial part of the module weight will be supported by the existing vessel with the outboard module supports (legs) connected to the sponson 2, 2', 3, 3'. As the upper part of the sponson 2, 2', 3, 3' may be lower than the main deck then the outboard module legs will be longer than those inboard supports which are connected to the existing deck.

A possible arrangement for the liquefaction process comprises, among other elements:

- steam Turbine electrical Generators (STG) and associated vacuum condenser exchangers, Seawater lift pumps,
- storage space 11, 11', 22, 22' for a quantity of stabilised condensate,
- condensate export pumps,
- sea water lift deep-well electric pumps mounted in caissons,
- sea water used for cooling of topside equipment,
- cooling Medium/Seawater (CM/SW) plate exchangers for main process cooling located below sea level to reduce power demand on the sea water lift pumps,
- additional ballast—either active SW or passive permanent inhibited water,
- local Equipment Room (LER) that contains electrical/motor switchgear and some local control equipment can be built long and thin, or divided into two rooms (one for electrical and one for instruments),
- storage of any potential single mixed refrigerant make up refrigerants, if applicable (typically ethane, propane and butanes),
- air compressors, driers, nitrogen generation, fresh water makers (some or all of these may be fitted within the engine room depending on the tanker design),
- fore-to-aft escape tunnel (this may be above deck, or not installed at all),
- fore to aft cable ways and fire water piping headers (these may also be above deck),
- gas turbine driven compressor modules for the LNG refrigeration system,
- end flash and boil off gas compressors (if required),
- LNG export system equipment for side-by-side offloading (hose or rigid arm system possible),
- inlet conditioning (separation, heating and/or cooling) facility,
- condensate stabilisation facility,
- mol sieve dehydration facility,
- amine CO2 removal facility,
- mercury removal facility,
- LPG extraction (distillation) facility,
- fuel Gas system,
- flare drums and stack/vent masts,
- lay-down module and cranes.

The LNG FPSO will also comprise a refrigeration facility, including a main LNG refrigeration plant, which is to be powered by direct mechanical drive. Ideally such a LNG refrigeration plant uses two 50% gas turbines and is located on the top of one of the sponsons 2, 2', 3, 3'.

The simplest refrigeration system that is best suited to this concept is one of the dual refrigerant loop nitrogen and methane based systems because there is no need to produce or store refrigerants. An alternative providing slightly higher production capacity (assuming the same installed drivers) is to use a single mixed refrigerant. In this case make up refrigerants would be stored in up to four very slim type-C tanks mounted very close to the refrigeration equipment. In this case refrigerants should ideally be imported, not made on board to minimize weight, congestion, manning requirements and hence minimize CAPEX.

The floating LNG plant 1 according is adapted to allow LNG transfer between the floating LNG plant 1 and a LNG carrier. This LNG transfer is schematically indicated in FIG. 4.

The gas is being transferred from the riser via the turret 10 to the process equipment on board of the floating LNG plant 1 where the gas is liquefied into LNG. Thereafter the LNG is stored within the LNG storage tanks 4. In order to offload the LNG a LNG tanker 50 is connected to the floating LNG plant 1. Then the stored LNG is being offloaded to the LNG carrier 50 via a transfer LNG hose that can be of any type (floating, aerial, submarine).

Figure 4:
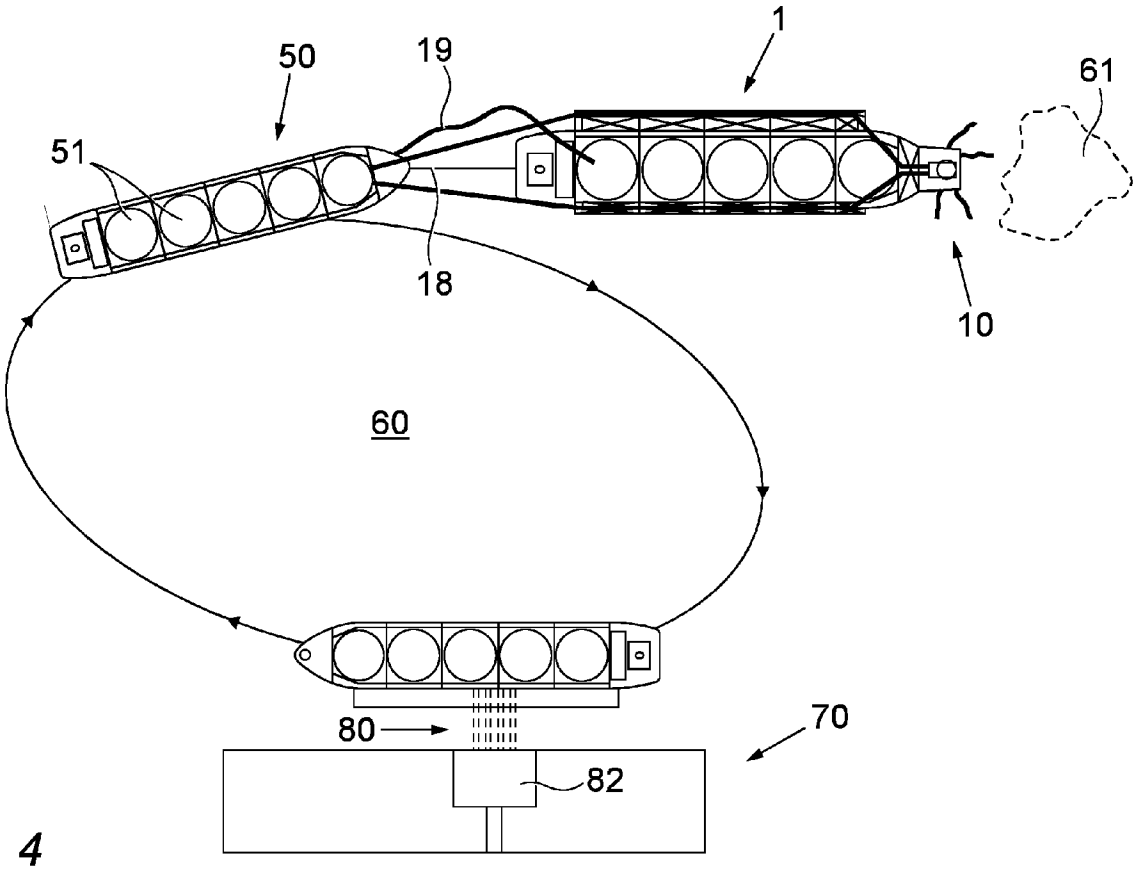
FIG. 4 shows a plan view of a gas distribution system using a floating LNG plant according to the present invention.

In FIG. 4, the offloading configuration shown between the floating LNG plant 1 and the LNG carrier 50 is a tandem offloading configuration where hawsers 18 are used to connect the LNG carrier to the LNG FPSO, the transfer LNG hose is for instance a flexible floating cryogenic hose 19.

FIG. 4 shows a plan view of a gas distribution system 60 using a floating LNG plant 1 according to the present invention. The gas distribution system 60 shown in FIG. 4 includes a floating LNG plant 1 that stores large amounts (in the order of at least 50 million standard cubic feet) of LNG produced from gas extracted from a distant LNG source 61. A mass of LNG is offloaded from the floating LNG plant 1 through the hose 19 to a LNG barge or shuttle tanker 50, which is provided with insulated tanks 51 where the very cold LNG is stored. The shuttle tanker 50 carry LNG from the floating LNG plant 1 to at least one of the local coastal station 70 that lies at the coast or near shore; for instance, in the vicinity of a community that consumes natural gas (either directly or by consuming electricity produced using natural gas as fuel). At intervals, the shuttle tanker 50 sails to the floating LNG plant 1, where insulated tanks 51 on the shuttle tanker receive LNG that has been temporary stored in the floating LNG plant 1. The shuttle tanker 50 then sails away to one of the local coastal stations such as 70.

Figure 5:
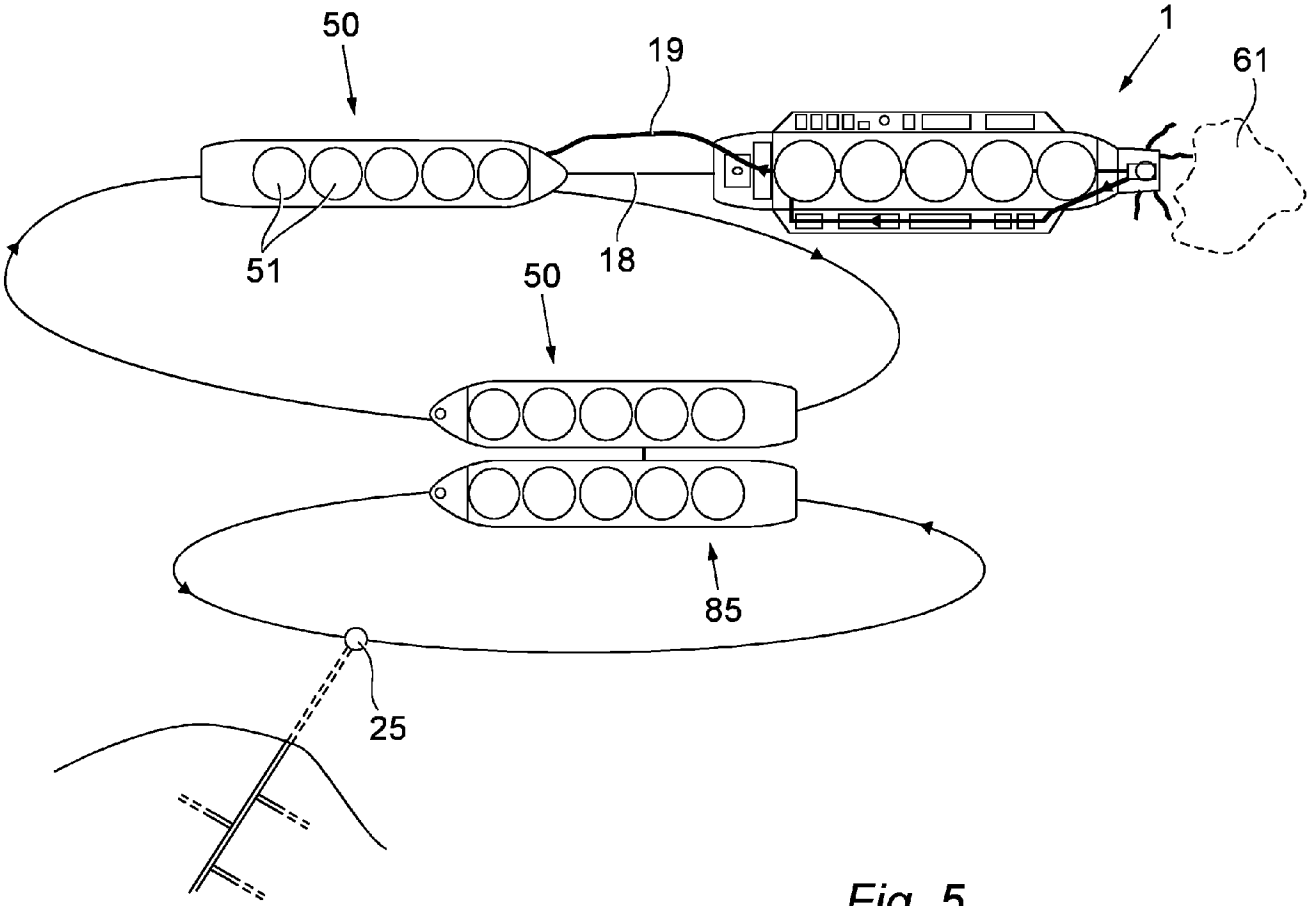
FIG. 5 shows an alternative offloading system for the LNG FPSO according to the present invention.

At the local coastal station 70, the LNG is transferred through an conduit 80 to an onshore regas storage facility 22 of the coastal station 70 (which may comprise a network of pipelines) where it is heated to into gaseous hydrocarbons and pumped into a gas distribution grid According to an alternative offloading system, shown in FIG. 5, the local coastal station includes a floating structure 85 such as an FSRU or a converted FSRU that is moored to the sea floor as by a gas discharge buoy or any type of receiving facility 25 moored by catenary lines, to allow the structure to weathervane, or that is spread moored. In the embodiment of a gas distribution system using a floating LNG plant 1 shown in FIG. 5, shuttle tankers 50 carry LNG from the floating LNG plant 1 to an offloading region where a LNG FSRU 85 has also been sailed. At this location, the FSRU 85 is designed to receive LNG from the LNG carrier 50 by "lightering" LNG, i.e. transferring the cryogenic liquid from ship to ship while sailing together at a safe location in calm waters away from the gas discharge buoy 25. After transfer of LNG, the FSRU sails to the coastal receiving facility and the shuttle tankers 50 returns to the floating LNG plant 1.

Figure 6:
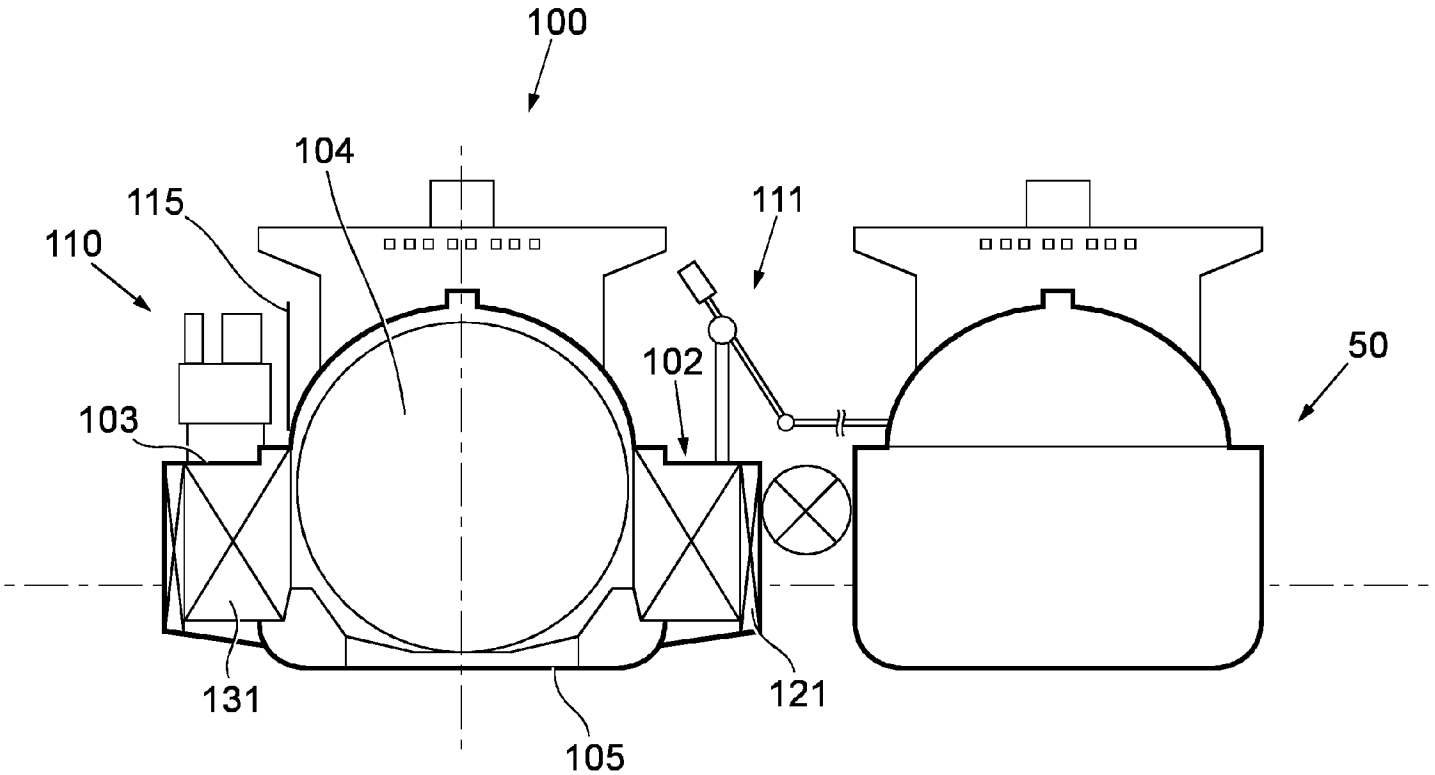
FIG. 6 shows a possible embodiment of the LNG FPSO according to the present invention which is adapted for side by side offloading.

FIG. 6 shows an alternative floating LNG plant adapted for a side by side offloading configuration. The floating LNG plant 100 comprises sponsons 102 and 103 each provided with a double hull protection by providing internal spaces 121 and 131 which provide either void or ballast space. These spaces 121 and 131 would typically be in the order of two meters in width.

According to FIG. 6, the top of the sponson 103 is typically used in order to support part of the process equipment 110 in the side by side configuration shown in FIG. 6. The sponson 103 which is not used to moor a LNG carrier in a side by side offloading situation could be used for support of the most hazardous process modules. That means that those potentially dangerous process modules are not placed between the two vessels 150. The vessel 50 could be any type of known LNG tanker (or LNG Carrier). Offloading according to FIG. 6 is possible via an arrangement 11 comprising rigid loading arms which are mounted on the upper deck of sponson 102, or via short LNG transfer hoses or combinations of rigid arms and LNG hoses (both not shown)

In order to improve safety of the arrangement according to FIG. 6, blast walls 115 can be placed between the potentially hazardous process modules on the sponson 103 and the spherical LNG storage tanks 104 or the LNG FPSO 100.

The invention claimed is:

1. A floating LNG plant comprising:

a converted LNG carrier with a hull and a plurality of LNG storage tanks;

at least a first sponson on one side of the hull for creating additional hull volume, wherein the at least first sponson is a double-walled sponson and is arranged to provide double hull protection;

LNG process equipment for LNG processing on the floating LNG plant;

a reservoir for storing fluids separated during the LNG processing, wherein a process equipment module for LNG processing on the floating LNG plant is installed on additional deck space created by adding of the at least first sponson on the one side of the hull, and a part of the process equipment module weight is supported by the hull of the converted LNG carrier with outboard module supports connected to the at least first sponson; and a new ballast tank in the additional hull volume created by the at least first sponson on the side of the hull, wherein a function of an original ballast tank that was present in an internal hull space of the converted LNG carrier is taken over by said new ballast tank and wherein the internal hull space for the original ballast tank is used for storing residual fluids which are produced in an LNG liquefaction process, wherein said residual fluids comprise at least one of oils and condensate.

2. The floating LNG plant according to claim 1, wherein the process equipment module for LNG processing on the floating LNG plant is installed on additional deck space created by the at least first sponson on the side of the hull.

3. The floating LNG plant according to claim 2, wherein the at least first sponson is used for supporting LNG transfer devices for at least one of loading or unloading LNG.

4. The floating LNG plant according to claim 3, wherein the converted LNG carrier is an LNG FPSO that is provided with the first sponson on the one side and a second sponson on another side of the converted LNG carrier, the first sponson is used for supporting the LNG transfer devices and the second sponson is used for supporting the LNG process equipment.

5. The floating LNG plant according to claim 3, wherein the at least first sponson is used for storage of a floating offloading hose.

6. The floating LNG plant, according to claim 1, wherein a power generation unit is placed within the at least first sponson.

7. The floating LNG plant according to claim 1, wherein the converted LNG carrier is an LNG FPSO that comprises a mooring system and a fluid transfer system, the fluid transfer system including a swivel and piping connecting the swivel to the LNG process equipment for LNG processing.

8. The floating LNG plant according to claim 7, comprising an external turret in order to allow the floating LNG plant to be weathervaning moored to a seabed via said external turret.

9. The floating LNG plant according to claim 7, comprising an offloading buoy in order to allow the floating LNG plant to be weathervaning moored to a seabed via said offloading buoy.

10. The floating LNG plant according to claim 1 wherein an outer shell of the at least first one sponson is provided with a collision protection.

11. The floating LNG plant according to claim 10, wherein the outer shell of the at least first sponson is protected against collision damage using SPS.

12. The floating LNG plant according to claim 1, wherein the space for the original ballast talk is used to partially house a newly constructed tank for said fluids wherein said tank extends for its remaining part into the space created by the adding of the at least one sponson.

13. The floating LNG plant according to claim 1, wherein the original ballast tank is used for storing said fluids.

* * * * *